US005788236A

United States Patent [19]

Goldfarb et al.

[11] Patent Number: 5,788,236

[45] Date of Patent: Aug. 4, 1998

[54] APPARATUS AND METHOD OF PLAYING A COMPETITIVE STRATEGY GAME

[75] Inventors: Adolph E. Goldfarb, 1432 Eastwid Cir., Westlake Village, Calif. 94361; Martin I. Goldfarb, Santa Monica, Calif.

[73] Assignee: Adolph E. Goldfarb, Northridge, Calif.

[21] Appl. No.: 823,795

[22] Filed: Mar. 24, 1997

[51] Int. Cl.[6] ..... A63F 3/00; A63F 9/08

[52] U.S. Cl. ..... 273/264; 273/271; 273/153 S

[58] Field of Search ..... 273/284, 271, 273/281, 153 S, 282.3, 264

[56] References Cited

U.S. PATENT DOCUMENTS

| | | | |
|---|---|---|---|
| 1,206,334 | 11/1916 | Kohler | 273/271 |
| 2,391,520 | 12/1945 | Smith | 273/271 |
| 3,601,404 | 8/1971 | Weisbecker | 273/264 |
| 4,210,337 | 7/1980 | Obermair | 273/264 |
| 4,303,246 | 12/1981 | Strongin | 273/271 |
| 4,479,654 | 10/1984 | Moscovich | 273/271 |
| 4,521,024 | 6/1985 | Slade | 273/271 |
| 4,620,709 | 11/1986 | Palladino, Jr. | 273/264 |
| 4,921,251 | 5/1990 | Kanenwisher | 273/93 R |

*Primary Examiner*—Benjamin H. Layno
*Attorney, Agent, or Firm*—Ashen & Lippman

[57] ABSTRACT

A competitive strategy game playable by two or more players. The illustrated game includes a board defining a plurality of channels arranged adjacent to one another. Each channel has a plurality of positions arranged along the channel. Each player is provided with a set of player pieces, the player pieces of each set being visually distinguishable from the pieces of the other set. For example, the pieces of each set may be difference colors. The players take turns adding one or more of their pieces to selected channels. The channels each include structure to guide the process along the channel. The channels and pieces are proportioned and arranged to that when a piece is added to an already occupied position in a channel, the displaced piece that was in that position is shifted to an adjacent position in the channel, which in turn shifts additional pieces in the channel to new positions. Thus, adding one piece can shift a whole row of pieces along a channel and dramatically change the overall arrangement of the pieces on the board. At least one end of each channel is open to allow a piece on the position adjacent to that end to be displaced from that end position and from the board completely.

17 Claims, 4 Drawing Sheets

APPARATUS AND METHOD OF PLAYING A COMPETITIVE STRATEGY GAME

BACKGROUND OF INVENTION

There are obviously many strategy games where the players take turns competitively moving pieces about a base or board. A number of these involve rows or columns of pieces arranged adjacent to one another to form a matrix or pattern where the object of the game is to achieve a continuous line of like pieces, either longitudinally or transversely or diagonally.

The popular game "Othello" involves two sets of different color pieces arranged in rows. When the two end pieces of a line of the pieces are the same color, the entire line is changed to that color.

There are other games involving stacking pieces in generally upright columns that are adjacent to one another to attempt to achieve vertical, horizontal or diagonal lines of the same color or character pieces.

To applicant's knowledge all of these prior games involved adding one piece at a time to the playing board, and do not involve shifting or relocating adjacent or other play pieces when one play piece is added, to thereby achieve major far reaching changes in the overall arrangement of the pieces on the board.

SUMMARY OF ILLUSTRATED STRUCTURE EMBODYING THE PRESENT INVENTION

The game of the present invention as illustrated in the drawings involves displacing one or more additional play pieces when a new play piece is added to the board. This creates a much more complex and interesting game and one where it is much more difficult and challenging to anticipate the effect of future moves or placements.

In a presently preferred embodiment as illustrated in the drawings, a base or playing board is provided with a plurality such as four generally horizontal but slightly inclined channels arranged generally parallel and adjacent to one another. Each of the channels may accommodate a plurality of play pieces such as spherical balls. There is a stop at the lower end of each of the channels to retain balls disposed on that channel on the play board. The players take turns adding one or more of their balls to the lower ends of selected ones of the channels. Each new ball that is added to the lower end of the channel pushes or advances other balls already in that channel upwardly by one position. The positions may be visually or physically defined along the channel or may simply be defined by the size of the aligned pieces in a channel.

In one form there are four positions along each channel. If there are already three balls in that channel, placing an additional ball at the lower end of then channel advances all three of those balls upwardly one position each. This illustrated form of the game has three additional adjacent parallel channels to provide an overall 4×4 matrix. Thus, when a ball is added at the bottom of a channel and one or more additional balls are shifted to new positions along that channel, this changes not only the ball at the first or lower-most position, but also changes the balls at the additional positions along the channel. Thus, in one move there is a change in each transverse row as well as changes to the diagonal lines. These are in addition to the change in channel itself by the addition of the new ball.

In the illustrated apparatus, the rearward upper ends of the channels are open. After a channel is full, in this case when there are four balls in the column, the addition of a further ball at the lower first position causes the ball at the fourth or highest position to be displaced off of the open end of the channel onto a receiving area. That receiving area may be in the form of a return pathway that is inclined back toward the front of the game to a position in front of the player and at the starting lower ends of the channels. Since this allows balls to be continuously added, the game may terminate after a given time period or when certain scores are achieved.

IN THE DRAWINGS

DETAILED DESCRIPTION OF THE DRAWINGS

Figure 1:
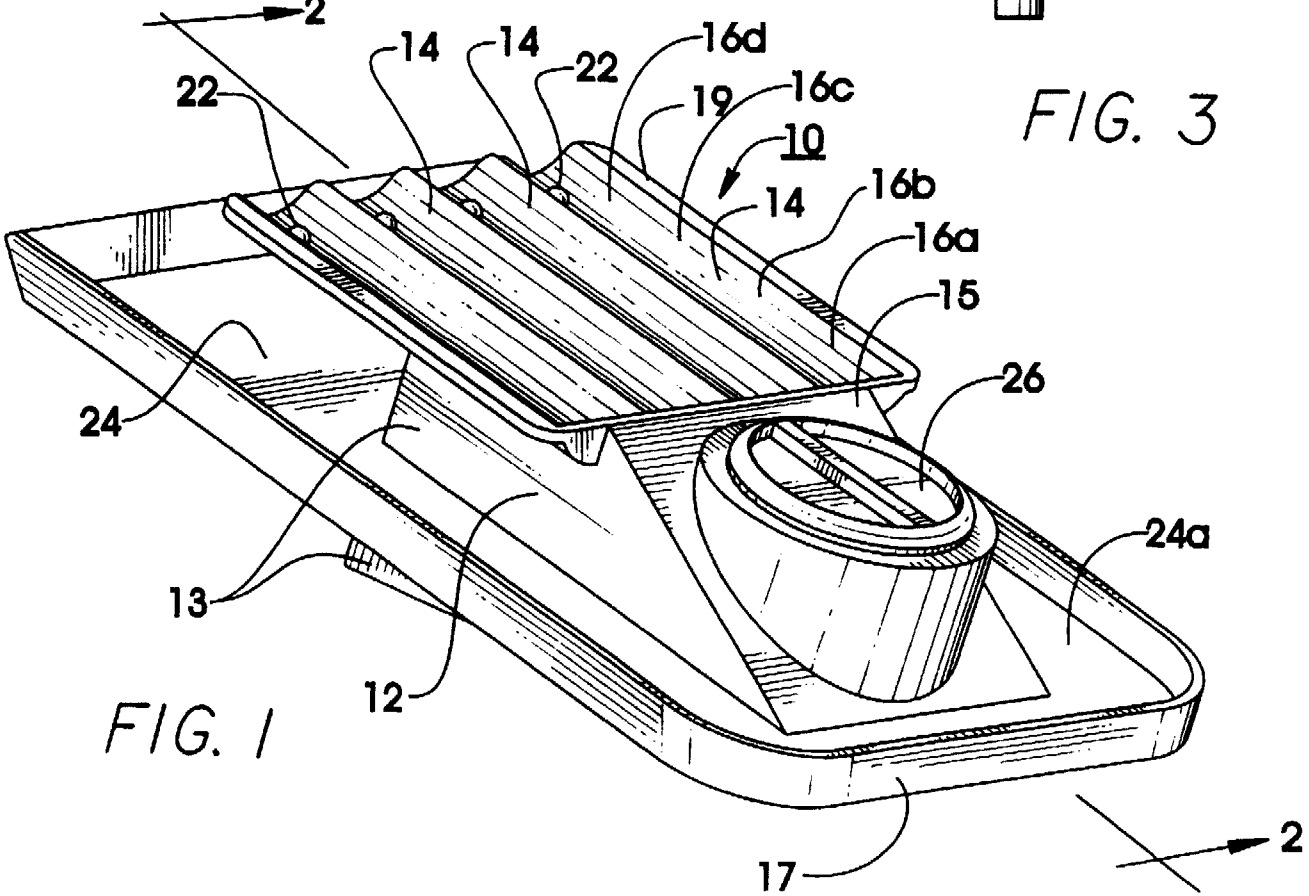
FIG. 1 is a perspective view of the a game apparatus embodying a presently preferred form of the invention.
Figure 2:
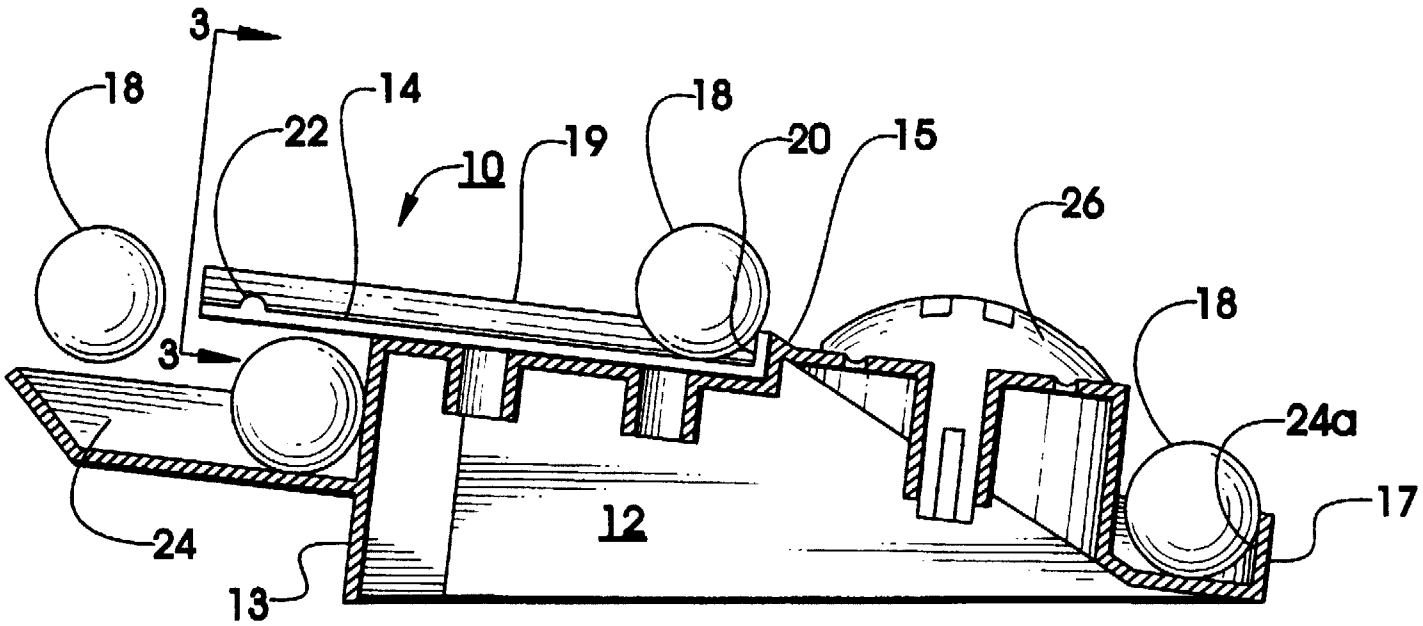
FIG. 2 is an enlarged transverse sectional view taken generally along Line 2—2 of FIG. 1.

FIGS. 1 and 2 illustrate a game apparatus 10 which embodies a presently preferred form of the present invention.

The game apparatus 10 includes a base 12 made of a suitable material such as molded plastic. The base 12 is formed with a plurality of generally upright side walls 13 and a generally horizontal top wall 15. The base 12 may rest on the lower edges of the upright side walls 13 on a suitable surface such as a table or the floor. The top wall 15 is generally inclined at a gentle angle going upwardly and rearwardly from a forward end 17, where the players are situated, to an elevated rearward end. An upwardly-facing play-piece receiving playing board 19 is provided on the top wall 15, either by a separate part connected to the top wall or by the formation of the top wall itself.

The play-piece-receiving board 19 illustrated in FIGS. 1 and 2 comprises four parallel channels 14 that extend generally from front to rear. The channels 14 are arranged side by side or adjacent to one another. Illustrated player pieces 18 are in the form of small spherical balls. Each player has a set of the balls. The balls of each set are visually distinguishable from one another as by being different colors. Each channel 14 is proportioned to receive four of the balls 18 along its length, each at a position 16 along the channel. Each channel 14 is provided with a retaining wall or stop 20 at its lower end to retain the lowermost ball 18 on its channel. That lowermost ball occupies a first or lowermost position 16*a* along the channel 14. The balls 18 and channels 14 are proportioned to receive up to three additional like balls in three added positions 16*b*, 16*c* and 16*d* disposed along the length the channel. As a ball is added manually by a player to the lower end of a channel, one or more balls already on that channel are thereby moved upwardly and rearwardly along the channel to each occupy a position one position higher up along that channel.

Adjacent the rearward uppermost end of each channel 14 there is a small upwardly facing dimple or projection 22 to prevent these balls 18 from inadvertently rolling off the upper end of the channel. However, when there are already four balls on a channel 14 and a new ball is added, the uppermost ball in the fourth position in that channel will thereby be moved over the projection 22 and discharged off the upper end of the channel into a receiving trough 24.

As shown in the drawings, this illustrated trough 24 is in the form of an inclined pathway which extends across the rear of the base 12, extends downwardly and forwardly at each side of the base, and then extends across the lower forward edge of the base where the balls can be readily accessed by the players. If preferred, the pathway 24 might only extend down one or the other side of the base rather then down both sides. Further, the trough 24 might merely hold the balls 18 at the rear or at one side of the base where they could also be accessed by the players.

It will be noted that the downward forward incline of the trough facilitates movement of the balls 18 in the illustrated apparatus 10 to the forward end of the base. The upright wall 13 at the rear of the base may be formed as by being curved or angled to facilitate the balls moving from that rear end to a side of the base.

At each players turn he or she may add one or more pieces 18 to the lower end of the channels 14 that the player chooses. The players may take turns adding pieces with a view to achieving alignment of that player's pieces along a channel, transversely or diagonally.

Suitable scoring indicating means 26 may be provided, as for example a single rotatable dial mounted at the rearward forward end 17 of the base between the forward ball storing portion **24*a* of the trough 24 and the channels 14. The dial 26 may be manually operated by the players to reflect the results achieved by their adding balls to the channels. For example, achieving four (4) of one player's pieces in a row may score a point. The dial 26** may start pointing straight upward, and be rotated one position or notch in either direction depending upon which player wins the point. The pointer thus moves back and forth at each point won. The first player to have the pointer reach a predetermined position of his her side can win the game. Alternatively, after a predetermined time, the winner is the player on whose side the pointer rests, regardless of the number of positions transversed.

Figure 3:
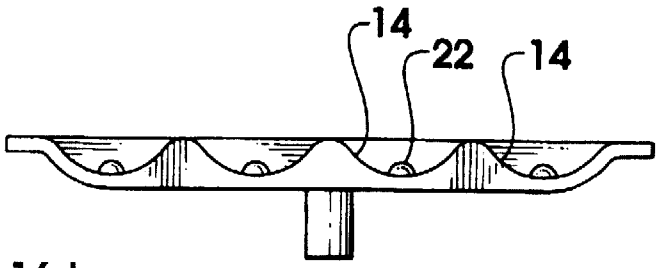
FIG. 3 is a sectional view taken generally along Line 3—3 of FIG. 2 showing the cross section of the channels.

The illustrated channels 14, as best seen in FIG. 3, are each provided with a curved transverse cross section to generally match or receive the spherical balls 18. This shape also forms or provides guides or means extending generally along the opposite edges of each channel 14 to maintain the balls within the channel and to guide them longitudinally along the channel as new balls are added to the lower end of the channel. The spherical nature of the balls 18 also insures that the balls will occupy the lower most positions in a channel 14. Even if they are initially jolted to a higher position, they will roll back down to occupy the lower most unoccupied positions along the channel.

Figures 4, 5:
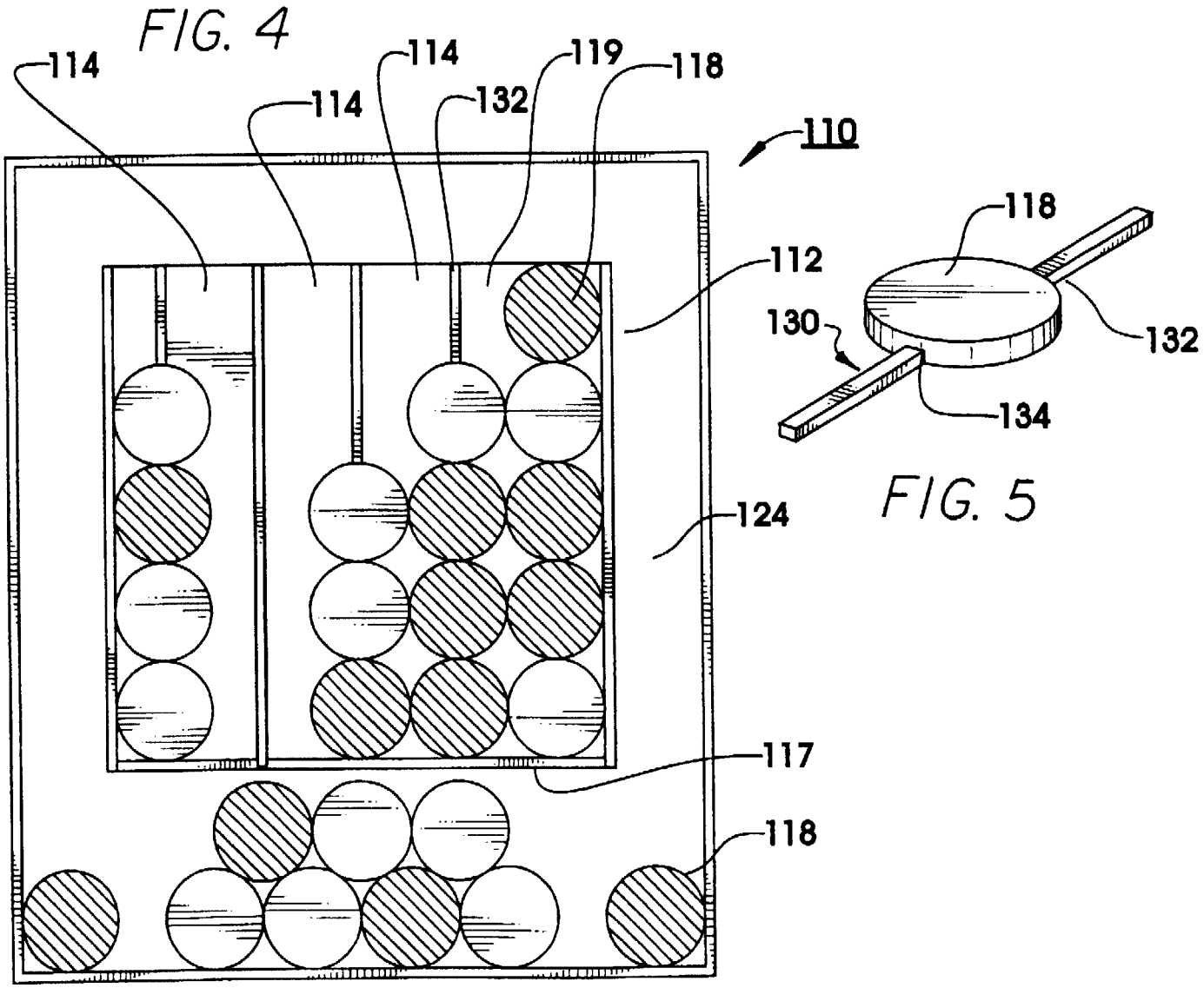
FIG. 4 is a plan view of an alternative form of the game apparatus.
FIG. 5 is an enlarged schematic perspective view of a portion of the apparatus of FIG. 4.

FIGS. 4 and 5 illustrates an alternative game 110 embodying the invention. In game 110 piece-receiving board surface 119 is generally horizontal and there is a guide means 130 in the form of an elongated rib 132 extending longitudinally down the center of each of the channels 114. The play pieces 118 illustrated in this form of the invention are checker-like disks each having an elongated slot 134 extending across their bottom wall to received the guide rib 132 of the associated channel. In this illustrated game 110 there are five channels 114, each having five positions therealong. It would be possible to have as few as two channels with three positions therealong or three channels with two positions along each channel. However, play value would be diminished in a 2×3 configuration since the options are greatly reduced and there is no opportunity for diagonals unless there are at least 3×3 positions. Further, the number of positions could be increased to whatever number were desired, noting that the complexity and difficulty of the game progresses at some point beyond the patience and interest of many potential users.

With regard to the horizontal board of FIG. 4, it will be noted that there is no requirement for a stop at the starting end of each channel 114 since the board surface 119 is level and the disk-shaped play pieces 118 essentially maintain whatever position they are put into. These play pieces 118 will slide forwardly along their channels 114 as new play pieces are added. If a play piece 118 is inadvertently struck or urged too far, it can simply be manually returned so that the play pieces in a channel occupy the forwardmost positions. When a play piece 118 is discharged from the rearward end of a channel 114, there can be a receptacle to accumulate those discharged play pieces or they can simply fall onto the table, floor or other supporting surface.

Other forms of guides means may be provided such as upright rails extending along the opposite sides of the channels. Obviously the rib and slot arrangement between the play pieces 118 and the channels 114 may be reversed, with the channels each having a slot and each of the play pieces having a mating rib.

Further, the projection adjacent the most rearward position along a channel 114 may in most cases be eliminated since the flat disk-like play pieces do not have the same tendency to keep rolling as do the spherical play pieces.

Figure 6:
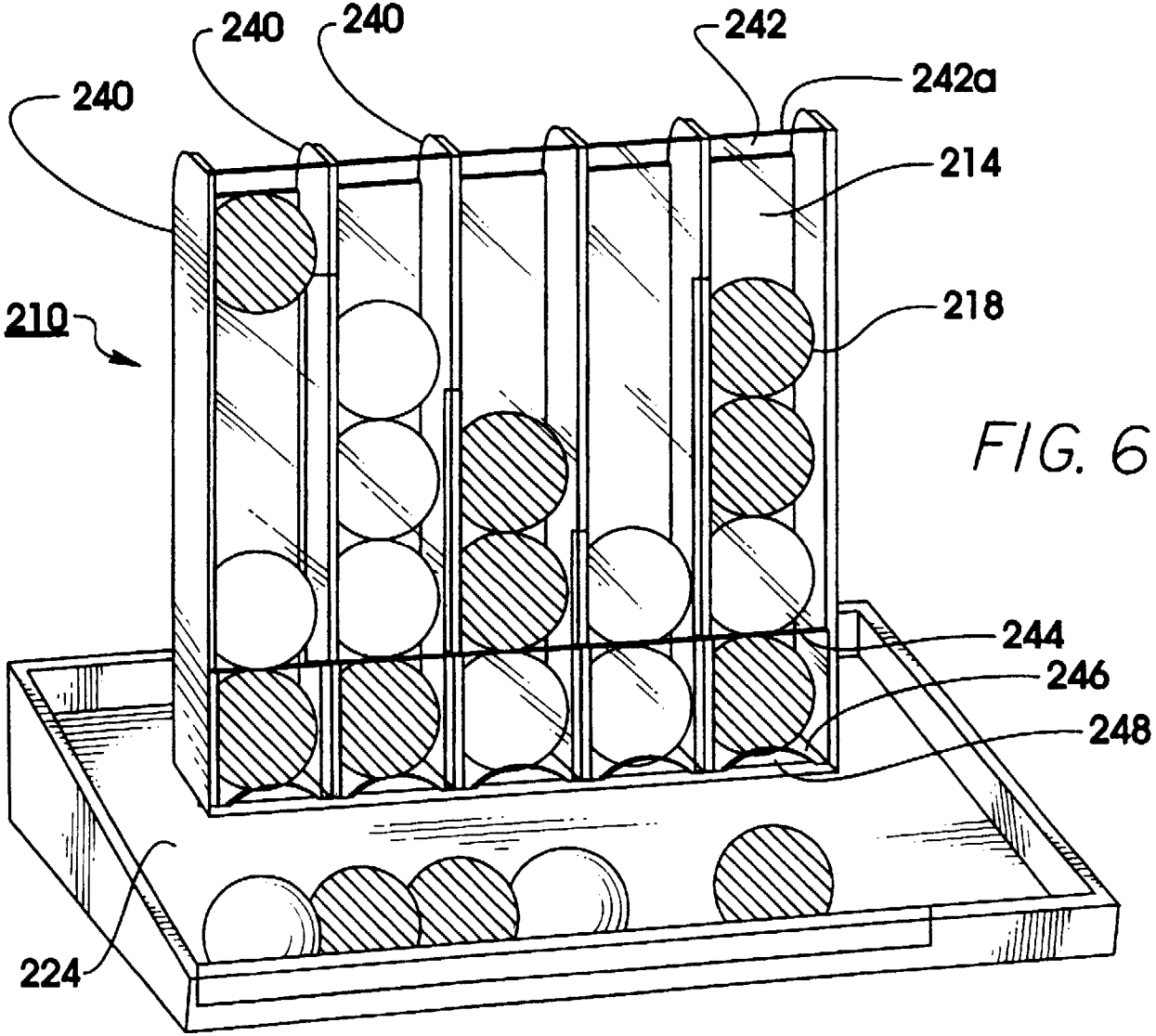
FIG. 6 is a perspective view of another alternative form of game apparatus.

FIG. 6 illustrates yet another modified game apparatus 210 which embodies the present invention. As shown in that FIG. 6, the channels 214 extend generally upright. Theses illustrated channels 214 are formed by a spaced-apart series of upright wall sections 240 and front and rear upright panels 242 of transparent material such as glass of clear plastic. The channels 214 are each open at their upper end and configured at their lower end to provide an entrance to receive new player pieces 218 one at a time. In this regard, the lower edge 244 of the front panel **242*a* is positioned somewhat more than the diameter of the play piece 218 above the bottom wall 246 of the channel 214. This allows the players to inset individual balls 218 into the entrances at the lower ends of the channel 214. There is also a small lip 248** at the front of each entrance to keep the balls from rolling out.

As a new play piece 216 is inserted into the bottom of a channel 214, other play pieces already in that channel will each be advanced upwardly by one position relative to the play pieces in the adjacent channels. The illustrated upright channels 214 are arranged adjacent to one another, but they might be arranged otherwise such as in an L-shaped or triangle-shaped configuration as viewed from the top.

As with the other embodiments, when a channel 214 is full, the introduction of an additional play piece 218 at the lower end will cause the play piece at the upper end to be discharged from the channel.

In the play of the various forms of the game, the players take turns adding one or more of their play pieces to the ends of the channels in an effort to achieve desired game results such as creating alignment of a specified number of their play pieces with one another in the matrix. The players may achieve certain scores for achieving certain predetermined results depending upon such criteria as the length of the line of like play pieces or the direction of such line. If desired, some selected number of each players play pieces may have special value, which will also affect the scoring such as doubling the score when such a play piece is involved in a line that the player achieves.

Various modifications and changes may be made in the illustrated structure without departing from the spirit and scope of the present invention is set forth in the following claims.

What is claimed is:

1. A competitive strategy game comprising:

a) two sets of rollable player pieces, the pieces of each set being visually different from the pieces of the other set, b) a game board, c) a plurality of elongated channels on the board, said channels each having one end that is elevated above the other end, said channels being arranged adjacent to one another for receiving player pieces, each channel having a plurality of positions arranged there along for each receiving one player piece, each channel having means for engaging pieces to guide them along their associated channels, each channel having an immovable blocking section at it's lower end to prevent downward movement of the rollable player pieces, the upper end of each channel having limiting retaining means for 1) limiting unobstructed movement of a player piece beyond said retaining means while 2) allowing a player piece to be readily pushed past said retaining means by a moderate force applied to a player piece lower in the stack in that channel, the pieces and positions being proportioned and arranged so that moving a new piece onto an already occupied lower position will shift upwardly the occupying piece, and any pieces in the channel above the occupying piece, to a new position along the associated channel or off the upper end of the channel, whereby when a channel is fully occupied by pieces, adding one new piece to an occupied lower channel position will shift upwardly all pieces occupying positions above that lower position and will discharge the piece from the uppermost position off the upper end of the associated channel.

2. The game of claim 1 wherein each of said channels have opposed longitudinal edges, said engaging means being in the form of raised portions disposed at said opposite longitudinal edges of the associated channel.

3. The game of claim 1 wherein said player pieces are in the form of generally spherical balls.

4. The game of claim 3 wherein said channels each have a generally curved shape when viewed in cross section.

5. The game of claim 3 further including a stop at the lower end of each channel for retaining the pieces in that channel in their respective positions.

6. The game of claim 3 wherein the retaining means comprises a shallow projection at the upper end of each channel to limit free rolling movement of the pieces from that end of the channel.

7. The game of claim 1 further including a score-keeping mechanism mounted on the board at the forward ends of the channels.

8. The game of claim 7 wherein said score-keeping mechanism comprises a single selectively positionable pointer, movable in generally opposite directions to reflect scoring by the opposed players.

9. The game of claim 1 wherein there are at least three of said channels.

10. The game of claim 1 wherein each of said channels has at least three positions.

11. The game of claim 1 wherein there are at least three channels and each of said channels has at least three positions.

12. The game of claim 1 wherein said play pieces of one set are a different color than the play pieces of the other set.

13. A competitive strategy game comprising:

a) two sets of player pieces in the form of generally spherical balls, the pieces of each set being visually different from the pieces of the other set, b) a game board, c) a plurality of elongated channels on the board and arranged adjacent to one another for receiving player pieces, each channel having a plurality of positions arranged there along for each receiving one player piece, each channel having means for engaging pieces to guide them along their associated channels, said channels each having one end elevated above the opposite end, each of said elevated ends being generally opened, each channel also including means at the lower opposite end for retaining a player piece on the position adjacent to that lower opposite end, the pieces and positions being proportioned and arranged so that moving a new piece onto an already occupied position will shift upwardly the occupying piece, and any pieces in the channel above the occupying piece, to new positions along the associated channel or off the elevated end of the channel, each of said channels having a generally curved shape when viewed in cross-section, said game further including a guide-way for receiving balls discharged from the upper ends of the inclined channels.

14. The game of claim 13 wherein said channels are arranged with their lower ends directed forwardly toward the players and the guide way for receiving the discharged balls is inclined somewhat downwardly in the forward direction toward the players so as to return the discharged balls to a position in front of the channels and readily accessible by the players.

15. A game board for use with two sets of player pieces in the shape of spherical balls, the pieces of each set being visually different from the pieces of the other set, the game board comprising:

a plurality of elongated channels on the board, said channels each having one end that is elevated above the other end, said channels being arranged adjacent to one another for receiving player pieces, each channel having a plurality of positions arranged there along for each receiving one player piece, each channel having means for engaging pieces to guide them along their associated channels, each channel having a stop at its lower end for retaining pieces in the channel, each channel being generally open at its upper end so that a piece on the location at said end can be moved off of that location and the end of the channel, the pieces and positions being proportioned and arranged so that moving a new piece onto an already occupied position will shift the occupying piece, and any pieces in the channel above the occupying piece upwardly to a new position along the associated channel, or off the upper end of the channel, said game board further including a player piece receiving trough located adjacent to the upper ends of the channels for receiving and retaining player pieces that are moved off of the channels.

16. The game board of claim 15 wherein said trough includes a portion that extends to the forward ends of the channels, said trough portion being inclined downwardly from the rear toward the front.

17. A method of playing a competitive strategy game which includes two sets of rollable player pieces, the pieces of each set being visually different from the pieces of the other set, a game board and a plurality of elongated channels on the board, said channels each having one end that is elevated above the other end, said channels being arranged adjacent to one another for receiving player pieces, each channel having a plurality of positions arranged there along for each receiving one player piece, each channel having means for engaging pieces to guide them along their associated channels, each channel having an immovable blocking section at it's lower end to prevent downward movement of the rollable player pieces, the upper end of each channel having limiting retaining means for 1) limiting unobstructed movement of a player piece beyond said retaining means while 2) allowing a player piece to be readily pushed past said retaining means by a moderate force applied to a player piece lower in the stack in that channel, the pieces and positions being proportioned and arranged so that moving a new piece onto an already occupied lower position will shift upwardly the occupying piece and any pieces in the channel above the occupying piece to a new position along the associated channel or off the upper end of the channel, whereby when a channel is fully occupied by pieces, adding one new piece to an occupied lower channel position will shift upwardly all pieces occupying positions above that lower position and will discharge the piece from the uppermost position off the upper end of the associated channel, the method comprising the steps of:

a) having one player add one player piece to a lower position of a player-selected one of the channels, b) having the other player add a player piece to a lower position of a player-selected one of the channels, and c) repeating steps a) and b) until a desired game objective is achieved.

* * * * *